US009593896B2

(12) United States Patent
McRee

(10) Patent No.: US 9,593,896 B2
(45) Date of Patent: Mar. 14, 2017

(54) BOLT RIFLE ASSEMBLY

(71) Applicant: Scott McRee, Lesterville, MO (US)

(72) Inventor: Scott McRee, Lesterville, MO (US)

( * ) Notice: Subject to any disclaimer, the term of this patent is extended or adjusted under 35 U.S.C. 154(b) by 0 days.

(21) Appl. No.: 14/167,187

(22) Filed: Jan. 29, 2014

(65) Prior Publication Data

US 2015/0211820 A1 Jul. 30, 2015

(51) Int. Cl.

| | |
|---|---|
| ***F41A 3/00*** | (2006.01) |
| ***F41A 11/02*** | (2006.01) |
| ***F41A 3/66*** | (2006.01) |
| ***F41G 1/44*** | (2006.01) |
| ***F41C 23/14*** | (2006.01) |

(52) U.S. Cl.

CPC ..... *F41A 11/02* (2013.01); *F41A 3/66* (2013.01); *F41C 23/14* (2013.01); *F41G 1/44* (2013.01); *Y10T 29/49826* (2015.01)

(58) Field of Classification Search

CPC .. F41A 11/00; F41A 11/02; F41A 3/64; F41A 3/66; F41A 21/481; F41A 21/482; F41A 21/485; F41C 7/00

USPC ..... 42/75.01, 75.02, 75.03

See application file for complete search history.

(56) References Cited

U.S. PATENT DOCUMENTS

| | | | | |
|---|---|---|---|---|
| 2,205,857 | A * | 6/1940 | Marchand | 42/75.01 |
| 3,206,885 | A * | 9/1965 | Dye | 42/75.03 |
| 3,439,441 | A * | 4/1969 | Lawley | 42/75.01 |
| 4,312,146 | A * | 1/1982 | Koon, Jr. | 42/75.03 |
| 4,385,464 | A * | 5/1983 | Casull | 42/75.03 |
| 6,487,805 | B1 * | 12/2002 | Reynolds | 42/75.03 |
| 2009/0277067 | A1 * | 11/2009 | Gregg | 42/69.01 |
| 2011/0185618 | A1 * | 8/2011 | Jamison et al. | 42/75.03 |
| 2012/0204465 | A1 * | 8/2012 | Hasler | 42/75.03 |
| 2014/0026460 | A1 * | 1/2014 | Warburton et al. | 42/74 |

* cited by examiner

*Primary Examiner* — Gabriel Klein

(74) *Attorney, Agent, or Firm* — Mark O. Loftin, Esq.

(57) ABSTRACT

An expandable linear explosive shape charge positioner for severing tubular members whereby a plurality of arc-shaped charge chambers are positioned along the same plane and adjacent to the interior walls of the tubular members and detonated to sever the tubular members. The invention is placed within a tubular member and includes a remotely extendible framework having remotely detonable linear explosive shape charges enclosed therein. When in the collapsed position, the apparatus passes through constrictions within the tubular members. When extended, the framework is positioned transversely to the axis of the tubular member with the shape charges positioned adjacent the interior walls thereof. Shape charge chambers with angled ends are presented to provide overlap when the device is fully extended to better ensure complete separation of the tubular member at the discontinuities of the shape charges about the plane of severance.

9 Claims, 9 Drawing Sheets

BOLT RIFLE ASSEMBLY

BACKGROUND

1. Field of the Invention

The present invention relates to a bolt-action rifles and more particularly to rifles that are comprised of modular subassemblies, 2. Background of the Invention Some bolt-action rifles are comprised of a group of sub-assemblies that can be quickly broken down, cleaned and inspected, components replaced as necessary and quickly reassembled. This type of bolt rifle is often desirable for the soldier and military organizations that can standardize on parts for inventory and have a rifle that can be quickly inspected and reassembled. In its most basic form, a rifle of this type is comprised of an upper assembly and a lower assembly. The upper assembly includes a barrel, barrel lug, barrel cover-forearm assembly, sighting means and an action-receiver-trigger assembly. The lower assembly is typically comprised of a support means for the action-receiver-trigger assembly, a grip for holding rifle, and a rear stock piece. Various other subassemblies could be added to the lower assembly to offer various features for the rifle. For example, removable hand guards, grenade launchers, hinges for collapsing the weapon for transport, and shock-absorbing pads on the rifle stock can be added to the lower assembly. For the war fighter, basic objectives of a rifle of this style are 1) make the subassemblies of the upper and lower assemblies easy to assemble and dissemble, 2) make the upper and lower assemblies capable of integrating a number of standardized subassemblies to maximize the degree of customization of the rifle for the various situations in which the weapon may be used, and 3) allow the weapon to also be suitable to civilian use by making it capable of operating within restrictions applied to civilian firearms.

SUMMARY OF THE INVENTION

The present invention presents a new and unique way of splitting a bolt action rifle into upper and lower assemblies. Although this style of separating the rifle into two primary assemblies is similar to the AR-15, M-16 and M-4 platforms, the present invention has several distinct differences. The assemblies can be separated and pre-assembled so that the time required to reassemble is much reduced. The present invention establishes built-in mounting locations for various accessories to be readily attached. The system can be utilized, maintained and rebuilt without requiring a high level education and knowledge. The present invention's upper and lower assemblies can be assembled using the standard USMC M4 Armorers tool kit. The upper assembly can be pre-assembled and tested, placed into inventory and later mated to the lower assembly when needed. Similarly, the lower assembly can be pre-assembled and tested, placed into inventory and mated to the appropriate upper assembly when needed.

The upper assembly of the current invention includes a rifled barrel, barrel nut, a barrel cover-forearm subassembly and an action-receiver subassembly.

The lower assembly of the current invention includes a support means for the action-receiver subassembly, a rail design mechanical mounting assembly, an alignment slot for receipt of a magazine having an external release lever, an embedded cant level detector using a calibrated bubble level, a hinge assembly that allows the stock to be folded back toward the barrel for compact storage, a folder top connector mating the stock subassembly to the hinge and a main bottom connector. Additionally, the lower assembly comprises a rigid hand hold, a butt pad mount a cheek rest assembly and a pistol grip.

The concept presented by the invention allows the individual components to fabricated, tested, and preassembled for inventory and then matted to the appropriate lower assembly as required.

Similarly, the lower assembly can be built, tested, and preassembled for inventory. All components with in this system are universal and are completely interchangeable with no loss of accuracy or function of the rifle. This feature is of particular benefit to the war fighter and military planners who require a stockpile of rifles and a system of inventory control without compromising the weapon's accuracy and durability The present invention also incorporates a bubble level precision machined into the lower assembly and placed in such a manner as to allow the shooter to alter the aim without having to change the stance or position of the shooter relative to his target. By consistently machining the cant indicator within the lower assembly, each rifle is highly repeatable in terms of its response to aiming at the target. Thus, any trained shooter can take any rifle from inventory and be confident that the rifle will fire consistently. This eliminates the need for a shooter to have a specific weapon that is calibrated to their particular shooting style. Now, more shooters can be trained for accuracy and maintain that accuracy with any rifle in the inventory.

In many instances, current focus on weapon development has been more on the gas gun platforms and optical sighting devices. In the last seven years or so, the focus has shifted to precision bolt rifles. It is a goal of this invention to analyze all the components related to a bolt rifle, as a whole. The current invention is a novel means of combining the components it takes to assemble a precision bolt action rifle. The current invention is designed and manufactured from the outlook that the bolt action rifle can be split into 2 main sub assembles, Upper and lower, sub-assemblies. Multiple components have been combined, lessening the amount of parts that can fail. There are no individual action support pillars that can fail. There are no conventional bedded compounds used to support the action-receiver. The magazine well is machined integrally so as to avoid having a part that could fail in this component subassembly.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
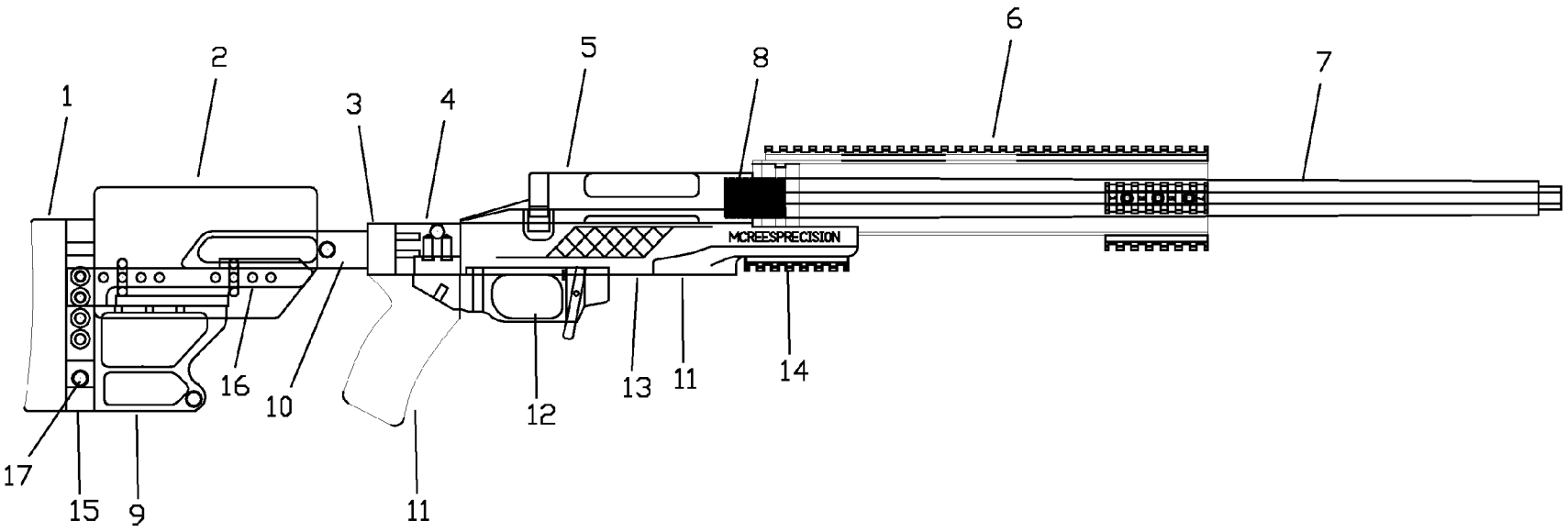
FIG. 1 is a side elevation view of a bolt-action firearm incorporating features in accordance with an exemplary embodiment.
Figure 5:
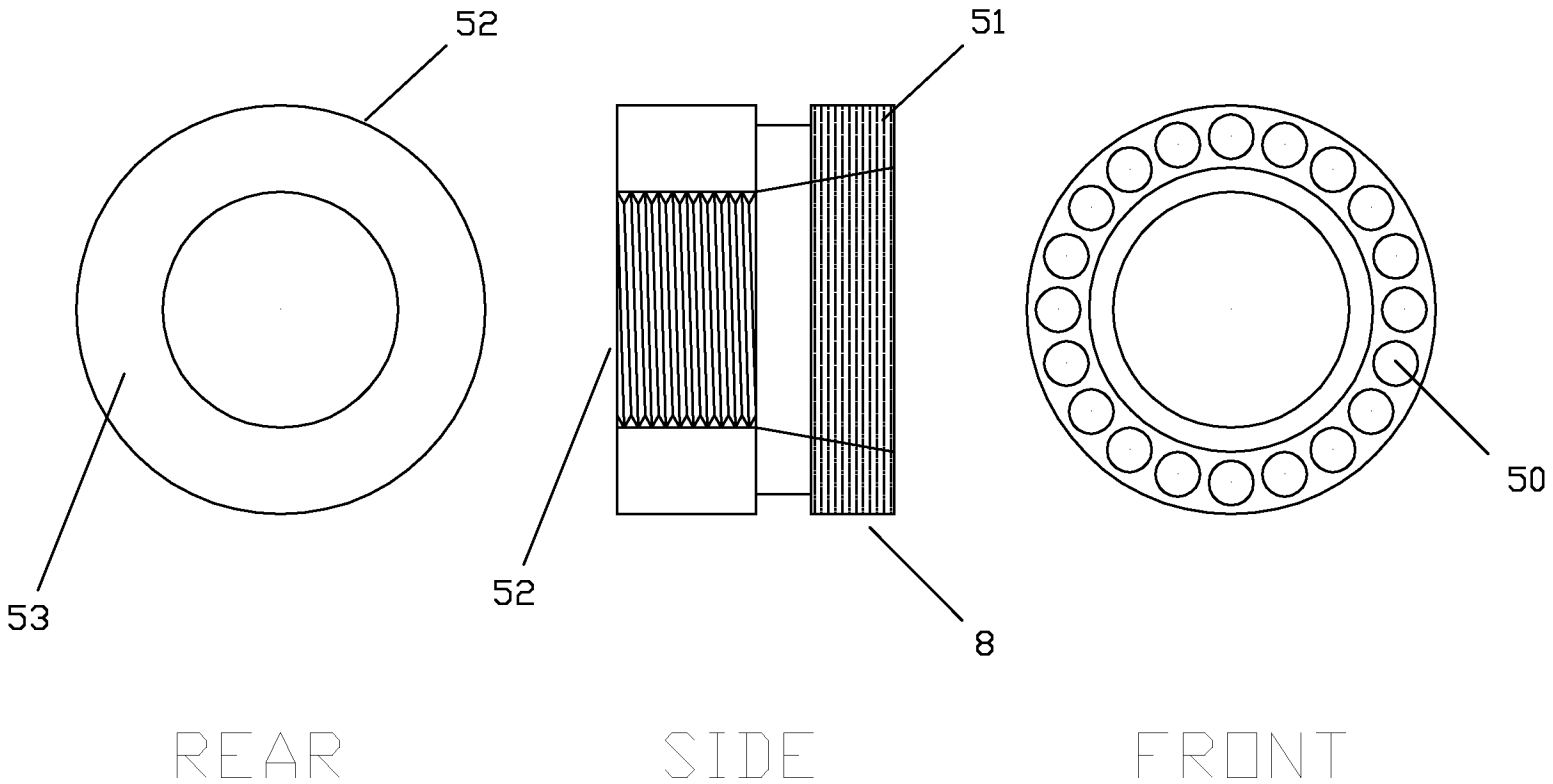
FIG. 5 shows a rear, side and front view of the barrel nut.

Referring to FIG. 1, there is shown, a side elevation view of a bolt-action firearm comprised of specific features in accordance with an exemplary embodiment of the present invention. The upper assembly is represented first by a rifled barrel 7 and a barrel nut 8. The rifle barrel is comprised of four basic parts: 1) the chamber, 2) the bore, 3) the muzzle and 4) the Action Receiver threads. The muzzle end is where the bullet is ejected from the barrel. The barrel of the current invention has the Action-Receiver threads using standard tenon threads per industry standard for brakes and suppressors. The bore is rifled and hand lapped. On the threaded end of the barrel is located a chamber of match grade and is machined to have an accuracy of 0.5 minutes of angle (MOA) or less. A barrel nut 8 is screwed onto the end of the barrel at the threaded end. In reference to FIG. 5, the barrel nut has a threaded forward end 51 for connection to a barrel cover unit 6 and a threaded rear end 52 for connection to the Action Receiver subassembly 6. The barrel nut has a radial hole pattern 50 in the front end to be used for applying locking torque. This bolt pattern is the same as used in the AR15, M16, M4 barrel lugs. This allows the armorer to use the same tool as used on the M4 to tighten the nut to the Action Receiver subassembly. The barrel nut of the current invention is designed to replace the lug design of standard single-shot rifles, gas-operated automatic and semi-automatic rifles. This barrel nut also changes how the recoil forces are dissipated when the rifle is fired. This design also allows more thread depth than conventional barrel lugs. The size of the barrel nut can be adjusted to fit different types of barrel diameters and because it is precision machined, it is a subassembly part that can be manufactured in quantities that can be inventoried and replaced on any rifle of a specified caliber.

In reference to FIG. 1, the barrel cover-forearm assembly 6 is shown. The primary function of the barrel cover is to provide a textured surface that can be securely gripped and to protect the shooter from the high temperatures that can developed on the barrel after repeated firing of the rifle. This is a standard item with a full length M1913 pic rail section along the 12 o'clock plane. This part has three M1913 pic rail sections at the forward muzzle end located at the 3, 6 and 9 o'clock planes. All pic rail sections are utilized to attach accessories.

Figure 2:
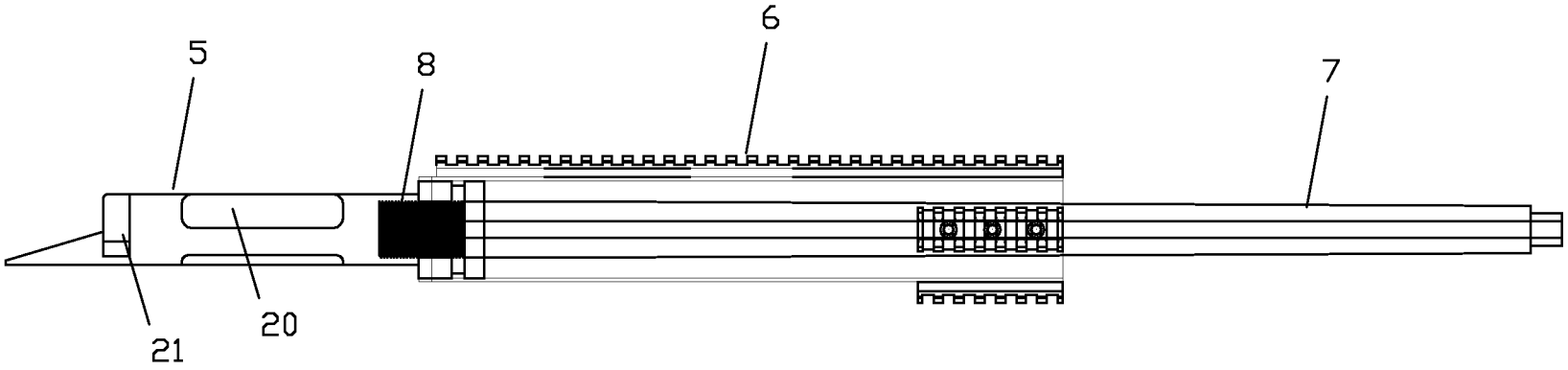
FIG. 2 is a side view of the preferred embodiment of the upper assembly of the current invention showing the cartridge chamber, barrel nut, barrel and barrel cover.

In reference to FIG. 2, the upper assembly of the current invention is shown with all of the subassemblies connected and secured together. This upper assembly shows the barrel 7, the barrel nut 8, the barrel cover 6 and the Action Receiver subassembly 5. By combining these parts in this unique way, accuracy and strength are improved. All of these parts are connected as one assembly, normally the forearm is not connected in this fashion and the barrel has no cover connected to it. This assembly is made in a similar fashion as with the AR15, AR16 and M4 style rifles of the prior art. This part set and assembly functions in a unique way since it has a totally different part that differs from AR-gas operated rifles of the prior art. In continued reference to FIG. 2, the Action Receiver Group subassembly is a cylinder shaped unit that houses the bolt and the firing pin assembly along with the trigger group. The shooter loads the cartridge into the assembly at 20 and secures the cartridge into the firing chamber by action of a bolt 21 that slides forward and is rotated clockwise into a locking position. This is a standard part known to those skilled in the art. This parts set will load the chamber and ignite the cartridge. The upper assembly shown in FIG. 2 is premanufactured and assembled for inventory. Testing has proven that when aligning and securing cylinders in a linear fashion, flexing and component interference is greatly reduced. Once preassembled and inventoried, the upper assembly can be quickly mated to the lower section and put into service or shipped to the end user. The barrel nut 8 screws over the barrel while the barrel threads into the Action Receiver 5. Once the depth of threading into the action receiver is checked with a chamber gauge to the proper depth, the barrel nut is tightened towards the action, which locks the barrel in place and provides an attachment thread pattern for the barrel tube/shroud 6 to attach to. The upper assembly is assembled with the current USMC M4 tool kit. The upper assembly also provides all the required locations for attaching accessories and these items are coplanar and aligned with the bore axis of the rifle.

In reference back to FIG. 1, the lower assembly is shown as comprised of the Action Receiver Support base 13, a mechanical mount assembly 12, the detachable magazine receiver 11, the embedded bubble-level cant indicator 4, hinge assembly, 3, the folder top connector 10, a main bottom connector 9, a butt pad mount 15, a cheek rest subassembly 2, and a pistol-style grip 11. The lower assembly parts set, provides an interface between the Upper Barreled assembly and the shooter-operator. This lower assembly is fully adjustable, component replaceable and houses the embedded rifle cant feedback mechanism 4. There are no parts to fail that will require the rifle to be taken out of operation. If damage to the rifle occurs the damaged part is removed and replaced with a new one. There is no change to the optical alignment or point of impact (POI) when replacing parts as long as the parts are reinstalled correctly. The lower assembly has 5 usable adjustments, which gives the shooter an improved level of comfort lessening fatigue and enhancing accuracy. The Lower Assembly can be pre manufactured and assembled, positioned in inventory as a whole and as individual parts. This ensures that in the case of damage, the rifle can be put back into service in a timelier manner than conventional bolt action rifle systems.

Figure 3:
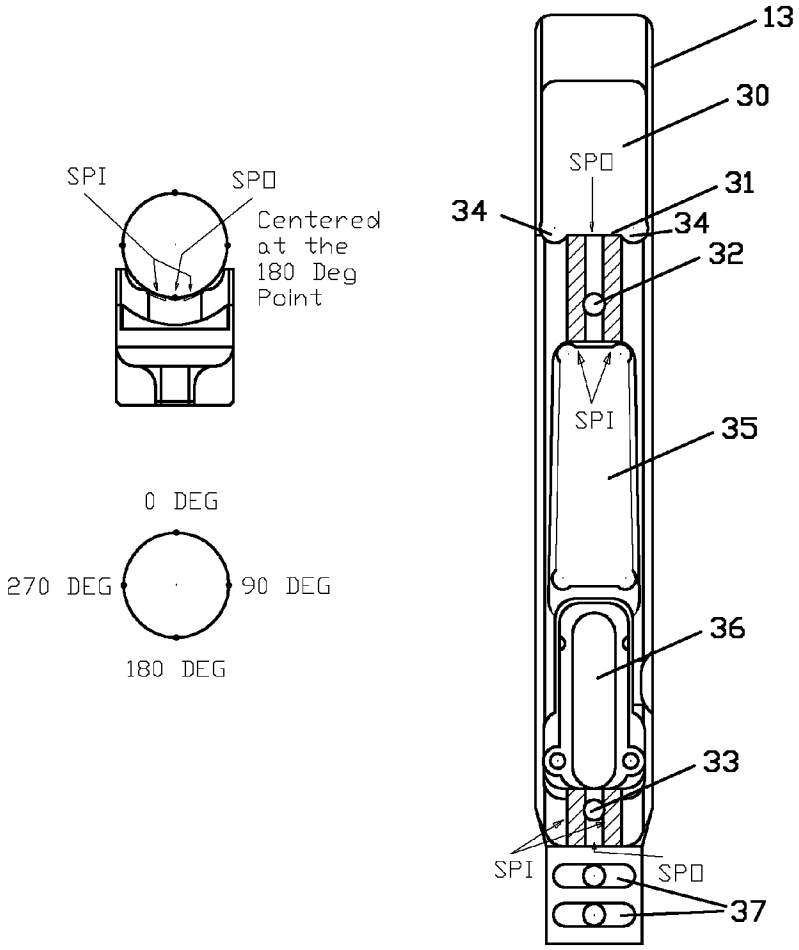
FIG. 3 is shows a top view and an end view of the Action Receiver Support subassembly. This is a precision-machined part that mates directly to the upper assembly of the rifle. The connecting points or "support pads" are indicated.

In reference to FIG. 3, a top view of the Action Receiver Support subassembly (ARS) 13 is shown. The ARS 13 is machined from a solid block of material is comprised of multiple functional elements. First, a forward cavity 30 is machined out of the ARS. Material is removed from this area to reduce weight. A machined flat surface 31 is located at the back end of this cavity to provide a contact surface with the rear end of the barrel nut 53. This contact point translates the forces generated by the explosion and ejection of the cartridge to the lower assembly. The upper assembly is connected to the lower assembly at bolt holes 32 and 33. However, these attachment means do not bear the majority of forces of the recoil. The contact between the machined flat surface 53 of the barrel nut and the corresponding machined flat surface 31 of the ARS translate the large majority of the recoil forces to the lower assembly. Two small rounded pockets 34 are machined out of the ASR to ensure that the barrel nut's rear surface only contacts the ARS at the proper location when assembling the components.

In continued reference to FIG. 3, a second cavity 35 is machined out of the ARS for receiving and securing a detachable box magazine. The dimensions of this cavity are dependent on the type of magazine used. In the preferred embodiment, the cavity is sized for receiving standard NATO or military style box magazines.

A third functional element is a cavity 36 machined out of the ASR for receiving a trigger subassembly. The dimension of this trigger subassembly is dependent on the particular trigger mechanism desired by the shooter. In the preferred embodiment, the trigger mechanism is a standard quality trigger mechanism. Any reference herein to a "firing mechanism" or a "trigger mechanism" is meant to refer to the "trigger subassembly."

A fourth functional element of the ASR is the plurality of ["support pads"] [SPI] and [SPI] located toward the front and back ends of the ARS. The Action Receiver Support Pads (or ARSP's) are machined into the subassembly allowing for the correct amount of contact with the Action Receiver subassembly of the Upper Assembly. Because manufacturers of rifle barrels and action receivers and have machining tolerances that can vary substantially, special formulas are used to determine the location and size of these support pads. These formulas allow for compensation of manufacturing tolerances and cradle the Action Receiver group-Upper assembly in a consistent and precise manner at all times. The consistency and interchangeability of the precise design of these support pads enhances the accuracy of the rifle and ensures that inventoried parts of subassemblies properly fit inventories of lower assemblies. Once the upper assembly is optically aligned with the desired Point of Impact (POI) for the fired rounds and the proper POI established, the upper assembly can be removed and replaced with an insignificant change to the established POI.

In the preferred embodiment of the current invention, the rifle's Action Receiver Support Pad (ARSP) is sized according to following formulas.

The Diameter (D) of the Action Receiver of the Upper Assembly 5 is measured.

The MD (Mean Diameter)=D−0.5%

Support Pad Combined Width (SPC)=38% of the MD

Support Pad Offset (SPO)=16.75% of the MD

Support Pad Individual Width (SPI)=0.5*SPC

SPO is located center lined at 180 degrees of MD

Each SPI is located at the out board termination points of the SPO. The SPO is located at both of the bolt connection points 32 and 33 that secure the upper and lower assemblies together. These support pads have a slight radius machined into them to approximate the arc of the Action Receiver subassembly 5. The forward support pads (i.e., the pair closest to the firing chamber) are slightly longer in length than the rear support pads the front pad. The length of the pads are limited by the length available relative to other cavities and functional aspects of the ASR. The forward pads extend from the barrel nut cavity 30 back towards the rear of the rifle until the magazine cavity is reached. The rear pads are slightly less in length as there is less distance available behind the firing mechanism cavity and the embedded cant indicator located at 37. All lower assemblies fitted with these pads according to these formulas will be interchangeable with all other upper assemblies without changing the accuracy of the rifle. This interchangeability is of great benefit to mass produced and inventoried weapons caches. The upper and lower assemblies are no longer required to be permanently coupled in order to maintain the requisite accuracy.

Figure 4:
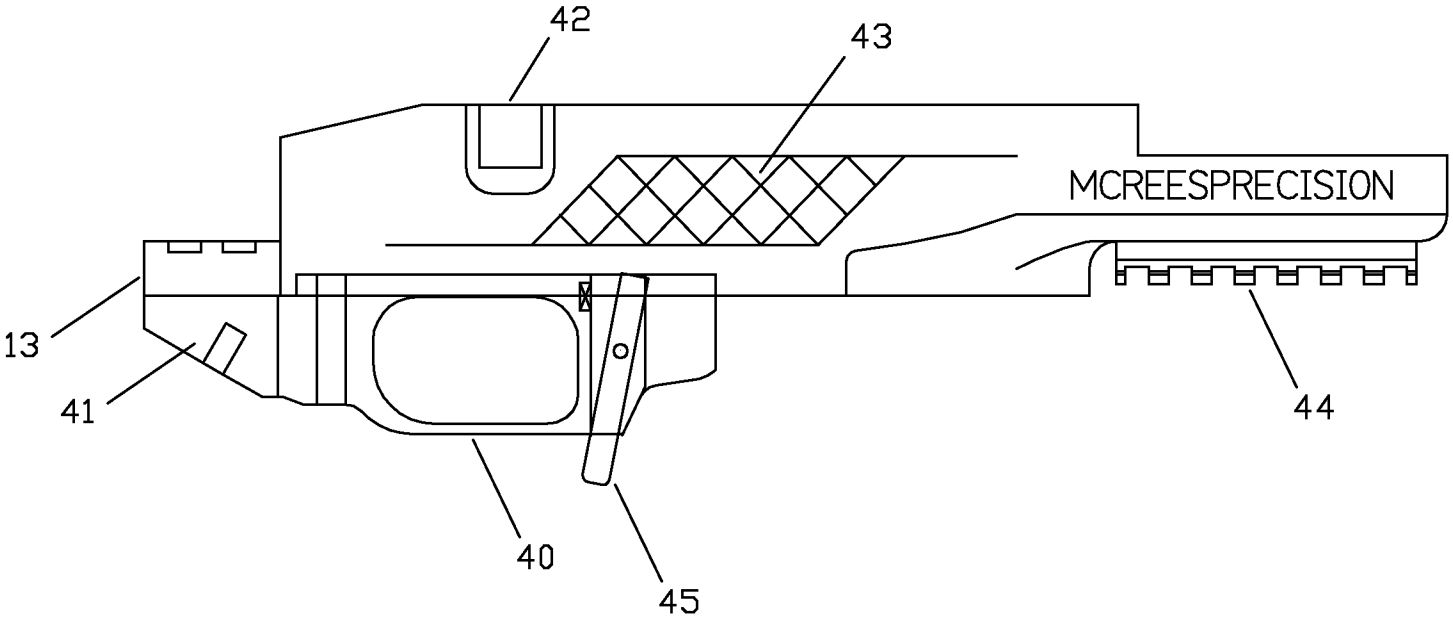
FIG. 4 is a side view of the Action Receiver Subassembly (ARS).

The remaining functional elements ASR can be seen in FIG. 4, which shows a side view of the ASR. A trigger guard 40 is shown. The trigger guard is comprised of a solid bar of material that extends from the body of the ASR and loops around to the back of the ASR in a standard shape of trigger guards well-known to those skilled in the art. The back end of the trigger guard contains a roughly triangular-shaped section of metal 41 with a notch for receiving a standard pistol-style grip subassembly. In continued reference to FIG. 4, a bolt notch 42 is shown for receiving and securing the bolt when rotated downward to lock the cartridge into the chamber.

The sides of the ASR are machined back creating a raised hatch pattern 43 into both sides of the ASR to provide a gripping surface when the rifle is carried and held for firing. On the front end of the ASR and projecting from the bottom surface is a short "pic rail" 44, which provides a standard means for attaching various accessories, such as carrying straps.

Figure 6:
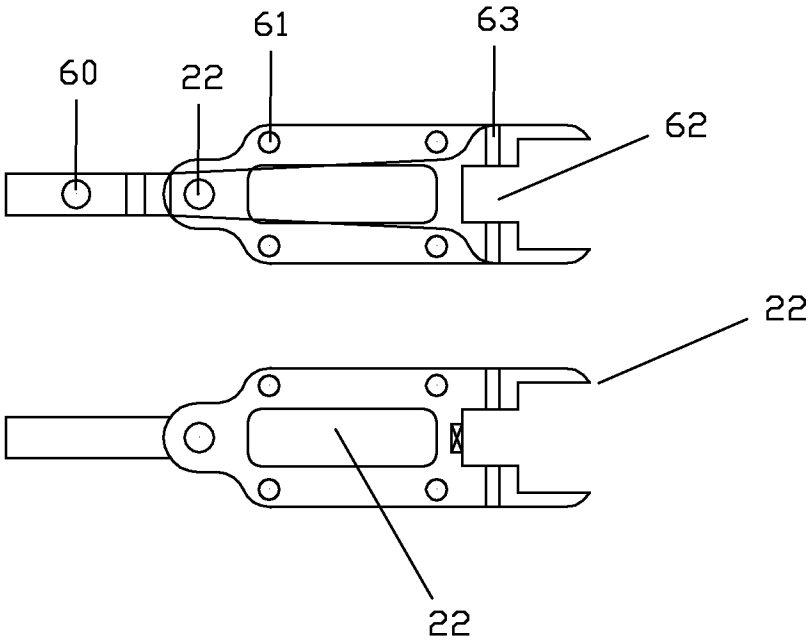
FIG. 6 shows a top and bottom view of the trigger guard that is attached to the underside of the ASR.

FIG. 6 shows a top and bottom view of the trigger guard. The trigger guard is secured to the underside of the ASR through holes 60 and the four holes 61 located symmetrically around the base of the trigger guard into which an attachment means, such as machine bolts are inserted and tightened into corresponding tapped holes on the underside of the ASR. On one end of the trigger guard at 62 is located a magazine release assembly. The magazine release assembly is comprised of a tab, pin and spring. The tab is placed in the slot at 62. A pin is inserted through the tab at 63. As the magazine is inserted into the ASR, the tab latches forward under action of the spring to prevent the magazine from falling out of the magazine well. When the shooter desires to eject the magazine, he pulls the tab backward, compressing the spring and clearing the contact with the magazine, allowing it to slip out of the magazine well.

Figure 7:
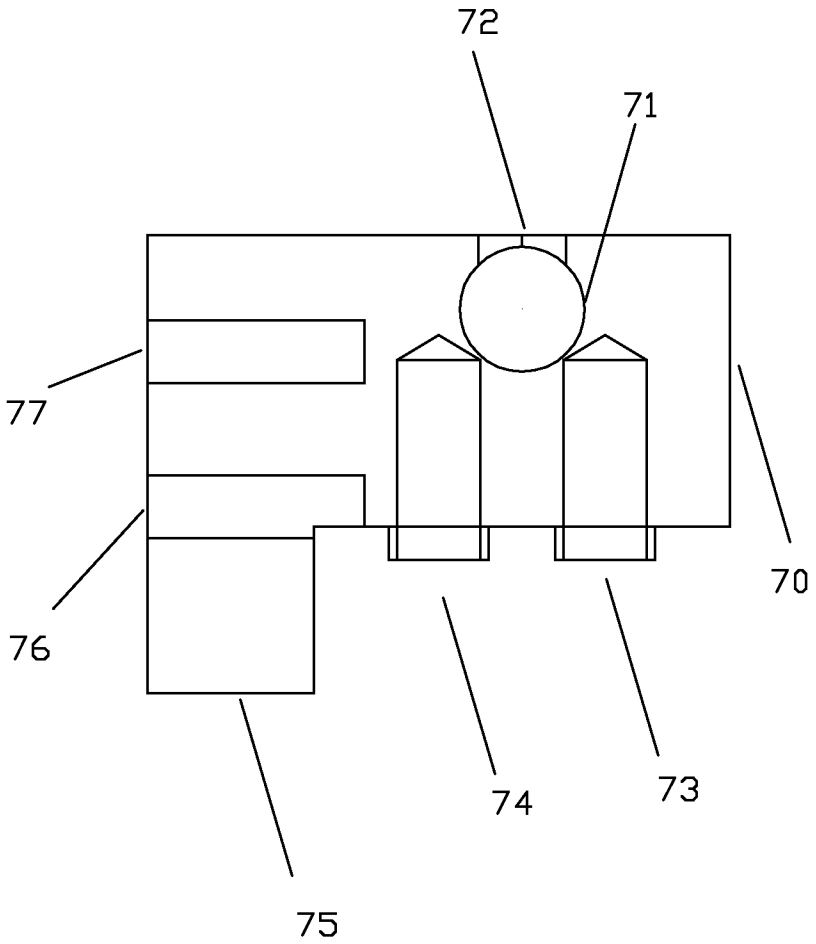
FIG. 7 shows a side view of the embedded bubble-level cant indicator that attaches to the rear end of the ASR and allows the shooter to determine the degree of rotation of the rifle about the axis of the barrel.

In continued reference to FIG. 3, the rear end of the ASR contains two oval-shaped cavities 37 with circular holes centrally located therein. These oval-shaped cavities are designed to receive an embedded bubble-level subassembly that measures and displays the cant of the rifle. This bubble level assembly is the subject of a separate application for Letters Patent by the inventor and whose specification is fully incorporated herein by reference. FIG. 7 shows a side view of cant indicator 70 showing the various elements machined into the block of metal or other solid material. Items 73 and 74 are holes in the cant indicator subassembly drilled and tapped to receive an attachment means, such as machine screws, for attaching the device to the oval-shaped cavities 37 of FIG. 3. In the preferred embodiment, these machine screws are ¼" diameter×⅝" length and tapped to standard machine threads. All external surfaces of the cant indicator subassembly are machined to flat to ensure that the device attaches securely and aligned properly to the ASR. In the preferred embodiment items 76 and 77 are machined and tapped cavities to receive four attachment means. This attachment means secures and aligns the device to the rear end of the ASR. In the preferred embodiment, these attachment means are 10⁄32" machine bolts. The cant indicator subassembly also includes a contact base 75 that extends down below the back end of the central stock to the pistol grip 11. This left side of this extended surface provides a contact surface for attaching a folding hinge piece or any other accessory item bolting on to the back end of the central stock. The bubble level is located inside a cavity 71 machined out of this subassembly for receiving a standard glass tube containing a phosphorous liquid with a bubble therein. The shooter can readily view the position of the bubble (e.g., the cant of the rifle) from the surface at 72 while lining up the shot.

Figure 8:
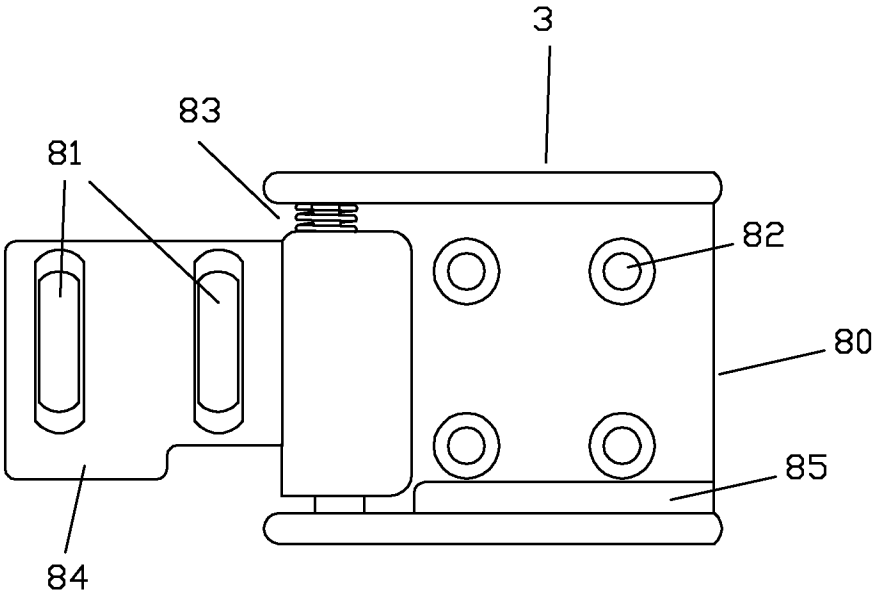
FIG. 8 shows an end view of the hinge assembly.

In continued reference to FIGS. 1 and 8, a hinge subassembly 3 is shown attached to the rear side of the cant indicator 4. This hinge subassembly is comprised of a solid back plate 80 that contains a plurality of holes 82 to receive attachment means to secure the hinge to the back of the cant indicator. In the preferred embodiment, the number of holes is four and the attachment means are 10/32" machine bolts. The rear rifle components are secured to the hinge through two slots 81. The hinge provides the ability to compact the overall foot print of the rifle. This is advantageous for transportation and to help keep the rifle unrecognizable. The hinge spring 83 provides a downward force to push flap 84 down behind ledge 85 securing the rear of the rifle in line with the barrel. When ready to fold up, the shooter lifts up on the rear of the rifle so that the flap 84 compresses the spring 83, clears the ledge 85 and can be folded alongside the ARS.

Figure 9:
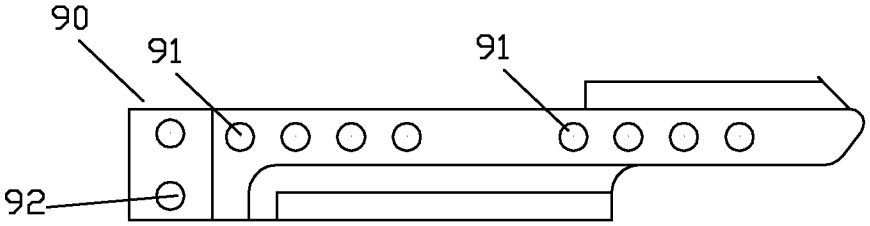
FIG. 9 shows a side view of the Main Bottom Connector.

In continued reference to FIG. 1, the Folder Top Connector 10 connects the fully adjustable rear section components to the hinge. The Main Bottom Connector 16 shown in FIG. 9 attached to the underside of the Folder Top Connector 10. The Main Bottom connector 90 is machined from a solid block and contains a plurality of drilled holes that allow lateral and vertical adjustment. Holes 91 are designed to receive a machine bolt once the shooter determines their preferred distance of the rifle rear components relative to the sights. As shown in FIG. 9, there are 4 positions in the preferred embodiment. Each of the holes 91 has a second hole spaced apart to match up and the shooter can select up to 4 preset positions by removal of the attachment means and sliding the rear components forward to the desired position. The attachment means are then reinserted and tightened. A second pair of holes 92 is drilled through the rear section of the Main Bottom Connector 90 to allow for two vertical positions of the rifle's rear components. To make the vertical adjustment, the attachment means is removed and the rifle's rear components are move up or down to the preferred position and the attachment means re-inserted and tightened. Attached to the underside of the Main Bottom Connector is the Rigid Hand Hold 9, which provides support sling connections and allows the operator to use the non-shooting hand to assist with supporting and adjusting the rifle for horizontal and vertical alignment. The rear shooting support connects to this item in addition to the butt pad mount 15. In the preferred embodiment, the Butt Pad Mount has four holes vertically aligned that fit over the back end of the Main Bottom Connector 16. Once the desired vertical position of the Butt Pad Mount is determined, two attachment means are inserted through two of these holes and tightened. On the rear of the Butt Pad Mount 15 is located the recoil absorbing pad 1, which is placed at the rear of the rifle. The Butt Pad Mount 15 also contains a support sling connections at 17.

In continued reference to FIG. 1, a vertically adjustable Cheek Rest Assembly 2 is provided which is comprised of a right side and a left side that independently adjustable vertically relative to each other. This allows the shooter to adjust the cheek rest height depending on whether the shooter is viewing the sights from either their "strong" side or "weak" side. While particular embodiments of modular rifles and rifle systems have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

What is claimed and desired to be secured by Letters Patent is as follows:

1. A bolt-action rifle comprising:

a barrel attached to an Action Receiver, the Action Receiver having an outer diameter, a mean diameter defined as 0.5% less than the outer diameter, two forward contact points and two rear contact points, a trigger, a magazine, and a lower assembly having a forward cavity, two forward support pads, a magazine cavity, a trigger cavity, and two rear support pads wherein the forward support pads are positioned between the forward cavity and the magazine cavity and wherein the rear support pads are positioned behind the trigger cavity.

2. The bolt-action rifle of claim 1 wherein a spacing between the forward pads equals a spacing between the rear pads with said spacings being between 16% and 17% of the mean diameter of the Action Receiver.

3. The bolt-action rifle of claim 2 where a sum of the widths of the forward support pads equals a sum of the widths of the rear support pads and is equal to between 37% and 39% of the mean diameter of the Action Receiver.

4. The bolt-action rifle of claim 1 wherein the forward and rear support pads of the lower assembly have a machined concave radius that radius equaling one-half of the mean diameter of the Action Receiver.

5. The bolt-action rifle of claim 4, further comprising a locking barrel nut for adjoining the barrel and Action Receiver, said nut having an externally-threaded forward end and an internally-threaded tubular rear end, wherein the threads of the forward end of the nut can receive a threaded barrel cover and the threads of the rear end of the nut having one end for receiving the threads of an Action Receiver and a second opposing end for receiving the threads of a barrel.

6. A method of assembling a bolt-action rifle, the method comprising the steps of:

providing a barrel and an Action Receiver, the Action Receiver having a outer diameter, a mean diameter defined as 0.5% less than the outer diameter two forward contact points and two rear contact points, adding a trigger, adding a magazine, and adding a lower assembly having a forward cavity, two forward support pads, a magazine cavity, a trigger cavity, and two rear support pads, wherein the forward support pads are positioned between the forward cavity and the magazine cavity and the rear support pads are positioned behind the trigger cavity, aligning the forward and rear contact points on the Action Receiver with the forward and rear support pads on the lower assembly; and securing the barrel and Action Receiver to the lower assembly using one or more fasteners.

7. The method of assembling a bolt-action rifle of claim 6 further having a spacing between the forward pads equaling a spacing between the rear pads and said spacings being between 16% and 17% of the mean diameter of the Action Receiver.

8. The method of claim 6 where the forward and rear support pads of the lower assembly have a machined concave radius, that radius equaling one-half of the mean diameter of the Action Receiver.

9. The method of assembling a bolt-action rifle of claim 6 where a sum of the widths of the forward support pads equals a sum of the widths of the rear support pads and is equal to between 37% and 39% of the mean diameter of the Action Receiver.

* * * * *